US011774110B2

(12) United States Patent
Ressler et al.

(10) Patent No.: US 11,774,110 B2
(45) Date of Patent: Oct. 3, 2023

(54) FIRE PIT TABLETOP ACCESSORY

(71) Applicant: Lamplight Farms Incorporated, Menomonee Falls, WI (US)

(72) Inventors: Kyle Ressler, West Bend, WI (US); Robert Woodruff, Oconomowoc, WI (US); Andrew Alan Harmeling, Milwaukee, WI (US)

( * ) Notice: Subject to any disclaimer, the term of this patent is extended or adjusted under 35 U.S.C. 154(b) by 283 days.

(21) Appl. No.: 17/126,004

(22) Filed: Dec. 17, 2020

(65) Prior Publication Data

US 2022/0196247 A1 Jun. 23, 2022

(51) Int. Cl.

| | |
|---|---|
| ***F24C 15/12*** | (2006.01) |
| ***A47B 37/04*** | (2006.01) |
| ***F24C 15/34*** | (2006.01) |
| *F24C 15/08* | (2006.01) |

(52) U.S. Cl.

CPC ..... *F24C 15/12* (2013.01); *A47B 37/04* (2013.01); *F24C 15/34* (2013.01); *F24C 15/08* (2013.01)

(58) Field of Classification Search

CPC .. F24B 3/00; F24B 1/181; F24C 15/12; F24C 15/34; F24C 15/36; F24C 15/08; A47B 37/04

See application file for complete search history.

(56) References Cited

U.S. PATENT DOCUMENTS

| | | | | |
|---|---|---|---|---|
| 3,593,702 | A * | 7/1971 | Zigomalas | A47J 36/02 220/573.2 |
| 6,182,650 | B1 * | 2/2001 | Tuttle | F16M 11/16 126/30 |
| 11,092,342 | B2 * | 8/2021 | Harrington | F24B 13/006 |
| 2001/0035098 | A1 * | 11/2001 | Peng | A47J 37/10 99/422 |
| 2012/0073561 | A1 * | 3/2012 | Gregory | F24C 1/16 126/25 R |
| 2014/0238378 | A1 * | 8/2014 | Scott | F24B 1/181 126/55 |
| 2014/0261379 | A1 * | 9/2014 | Mehler | A47J 33/00 126/25 R |

* cited by examiner

*Primary Examiner* — Alfred Basichas
(74) *Attorney, Agent, or Firm* — GableGotwals; David G. Woodral

(57) ABSTRACT

A table accessory for use with a fire pit. The table accessory may be supported by a fire pit for use as a table, for supporting a storage cover, or, when the fire pit is in use, may be moved below the fire pit for use as a heat shield. A plurality of accessory legs extend from the lower surface of the body. The terminal ends of the accessory legs are configured to be received on a top panel of the fire pit. A fire pit stand has a plurality of fire pit legs for supporting the fire pit. The fire pit legs define a fire pit leg height. The height of the table accessory is less than the fire pit leg height for facilitating locating the table accessory under the fire pit chamber of the fire pit for use of the table accessory as a heat shield.

13 Claims, 8 Drawing Sheets

FIRE PIT TABLETOP ACCESSORY

FIELD OF THE INVENTION

The invention relates to an accessory for use with a fire pit. More particularly, the invention relates to a tabletop accessory for locating above the fire pit and for use as a heat shield.

BACKGROUND OF THE INVENTION

Outdoor fire pits have, in the past, been permanent fixtures built from rock, concrete, metals, or other resilient and heavy materials. Often the fire pit is built directly on the ground and is not readily portable. Other fire pits have been developed that may be somewhat portable. However, in an effort to contain fire and ash, combustion properties are less than desirable. Smoky fires, possibly with little light or radiated heat, have been the result.

In an attempt to address the above and related concerns, Applicant filed an application for "Non-Gas Fire Pit", as shown and described in U.S. Pub. 2020/0096199, and assigned to Lamplight Farms Incorporated, hereby incorporated by reference.

It is desirable to provide an accessory for facilitating enhanced use and protection of the fire pit device described above.

SUMMARY OF THE INVENTION

To further enhance the functionality of the Non-Gas Fire Pit referenced above, and other devices sharing some of the features of the Non-Gas Fire Pit, a tabletop accessory is shown and described herein. The accessory of the invention may be used as a tabletop for a fire pit when the fire pit not in use, such as may be the case during warm summer months. The accessory of the invention has additional uses, i.e., the accessory supports a cover when the fire pit is stored. The accessory may be placed under the fire pit for use as a heat shield when the fire pit is in use. In one embodiment, the legs are removable for facilitating ease of shipping and storage.

In greater detail, a table accessory for use with a fire pit is shown and described herein. In one embodiment, the table accessory has a hollow body having an upper surface, a lower surface and width. In one embodiment, the accessory body is circular. In other embodiments, the accessory body may be square, rectangular, hexagonal, octagonal, or anther shape. A plurality of accessory legs extend from the lower surface of the accessory body. Each of the accessory legs have a terminal end.

The table accessory is sized to be supported by a fire pit. An example fire pit has an inner chamber wall defining a fire pit chamber having an upper end. The fire pit has a top panel that surrounds the upper end of the chamber of the fire pit. The terminal ends of the accessory legs are configured to be received on the top panel of the fire pit. A stand at a lower end of the fire pit has a plurality of fire pit legs for supporting the fire pit.

The table accessory defines an accessory height from the upper surface of the accessory body to the terminal ends of the accessory legs. The fire pit legs define a fire pit leg height. The accessory height is less than the fire pit leg height for facilitating locating the table accessory under the fire pit chamber of the fire pit for use of the table accessory as a heat shield.

DETAILED DESCRIPTION OF THE PREFERRED EMBODIMENTS

Figure 1:
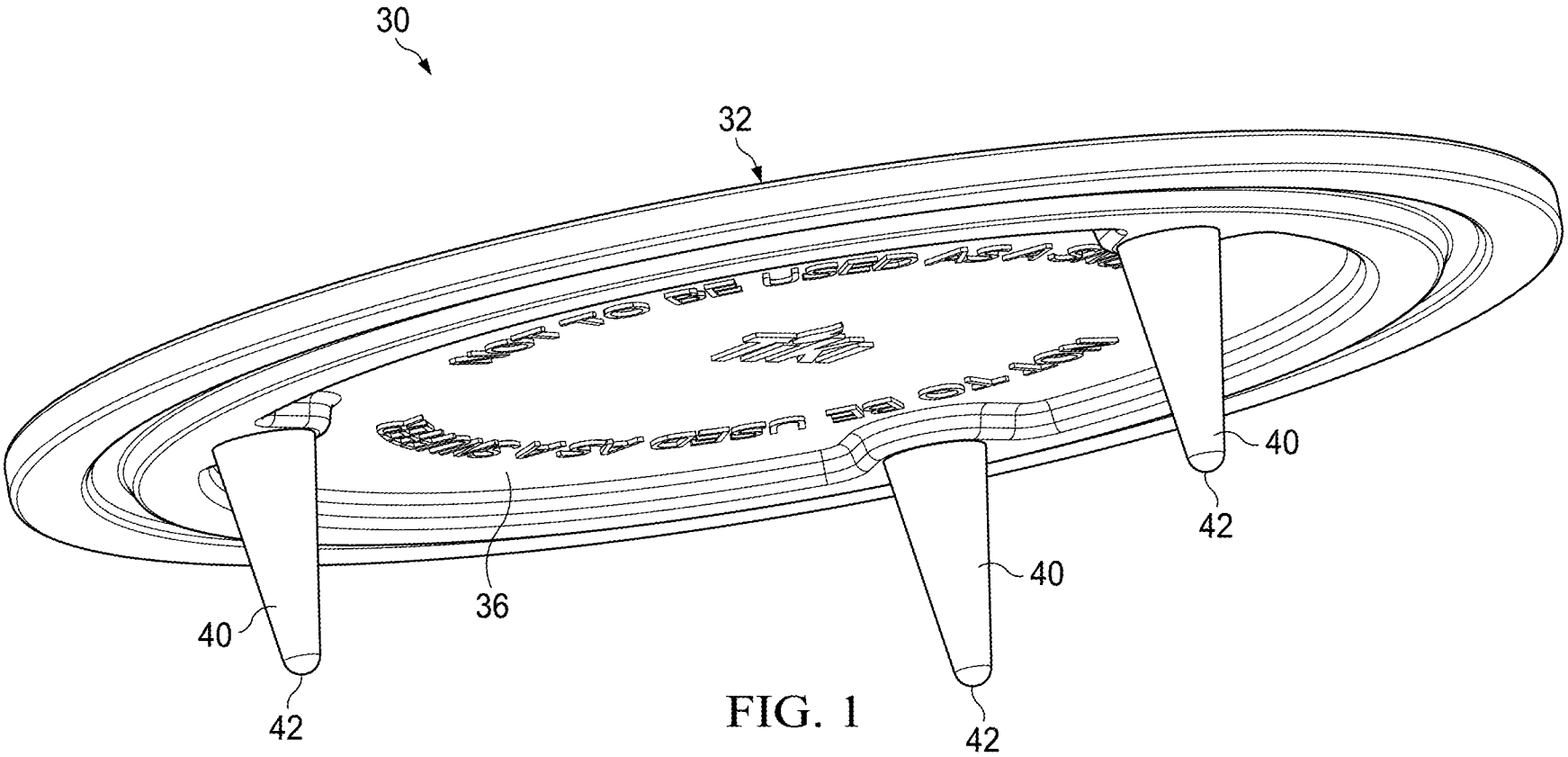
FIG. 1 is a perspective view of an accessory of the invention.
Figure 2:
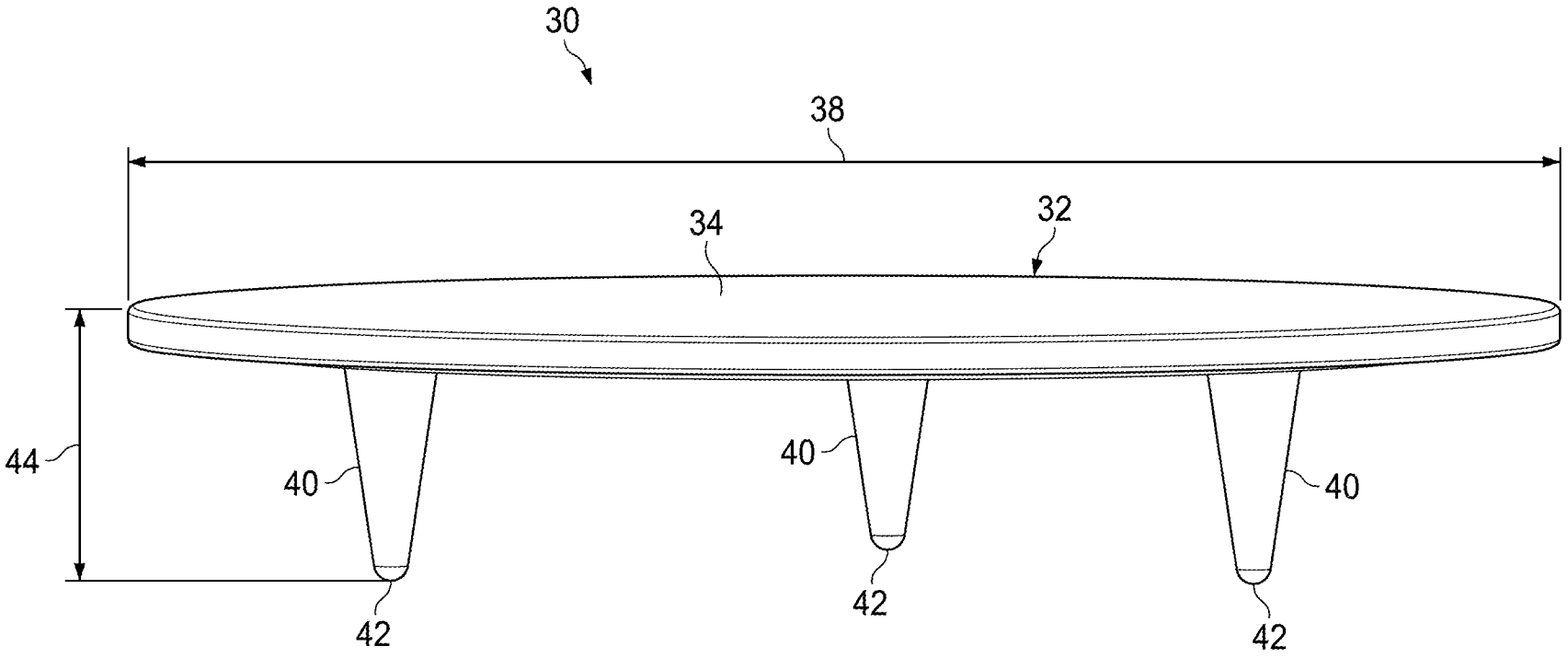
FIG. 2 is a perspective view of the accessory of FIG. 1.
Figure 3:
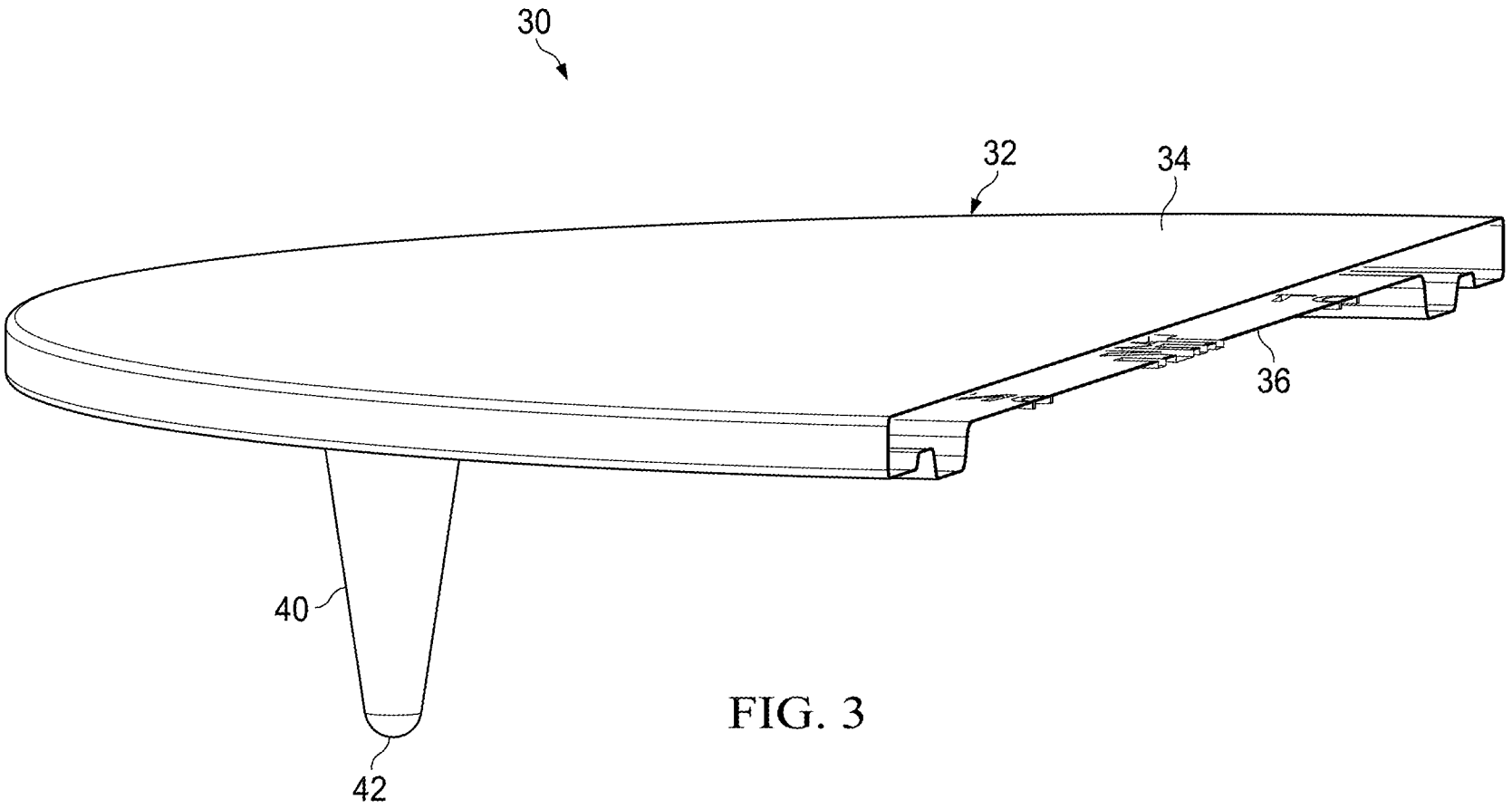
FIG. 3 is a perspective cross-sectional view of the accessory of FIG. 1.
Figure 4:
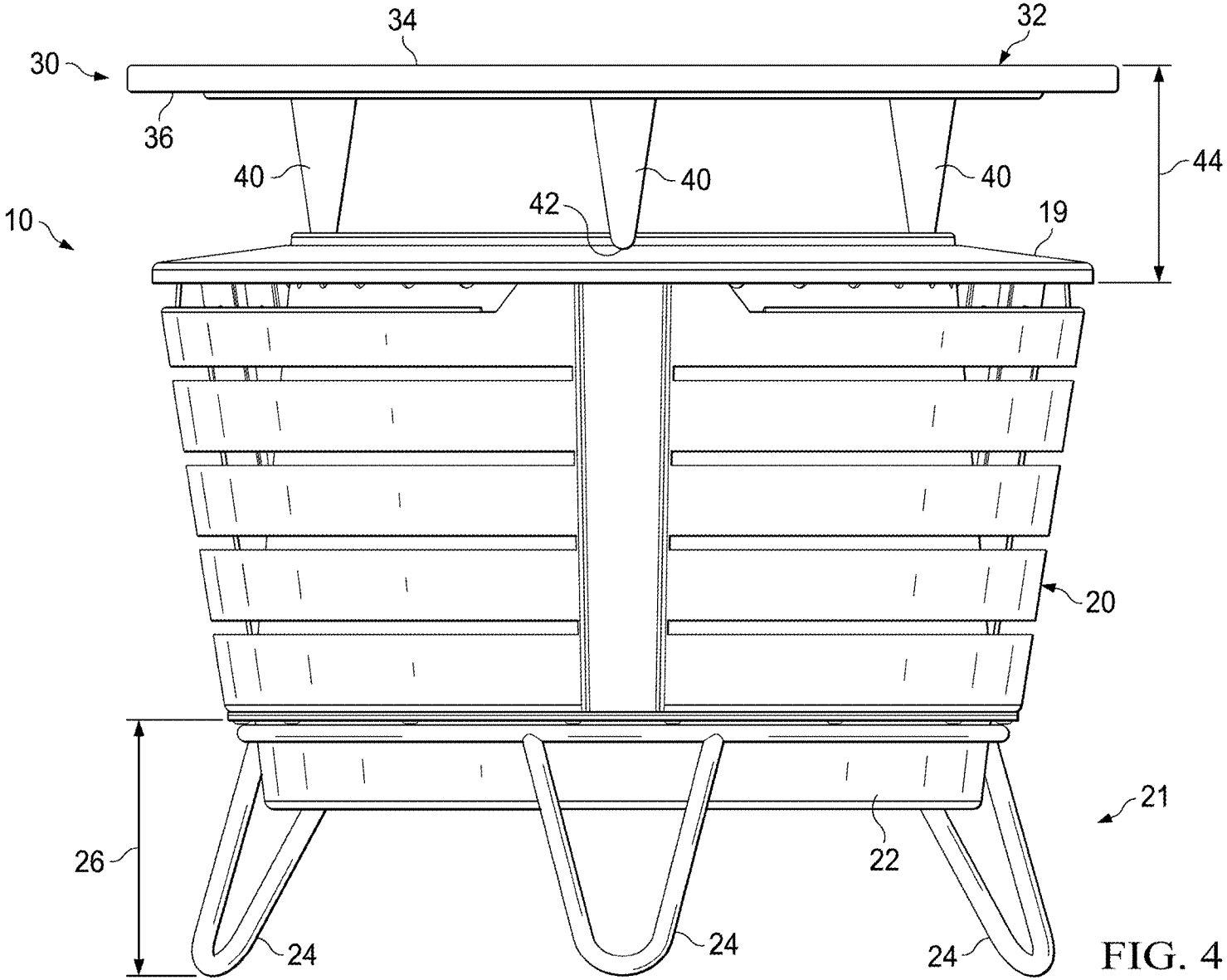
FIG. 4 is a side elevation view of an example fire pit with the accessory installed.
Figure 5:
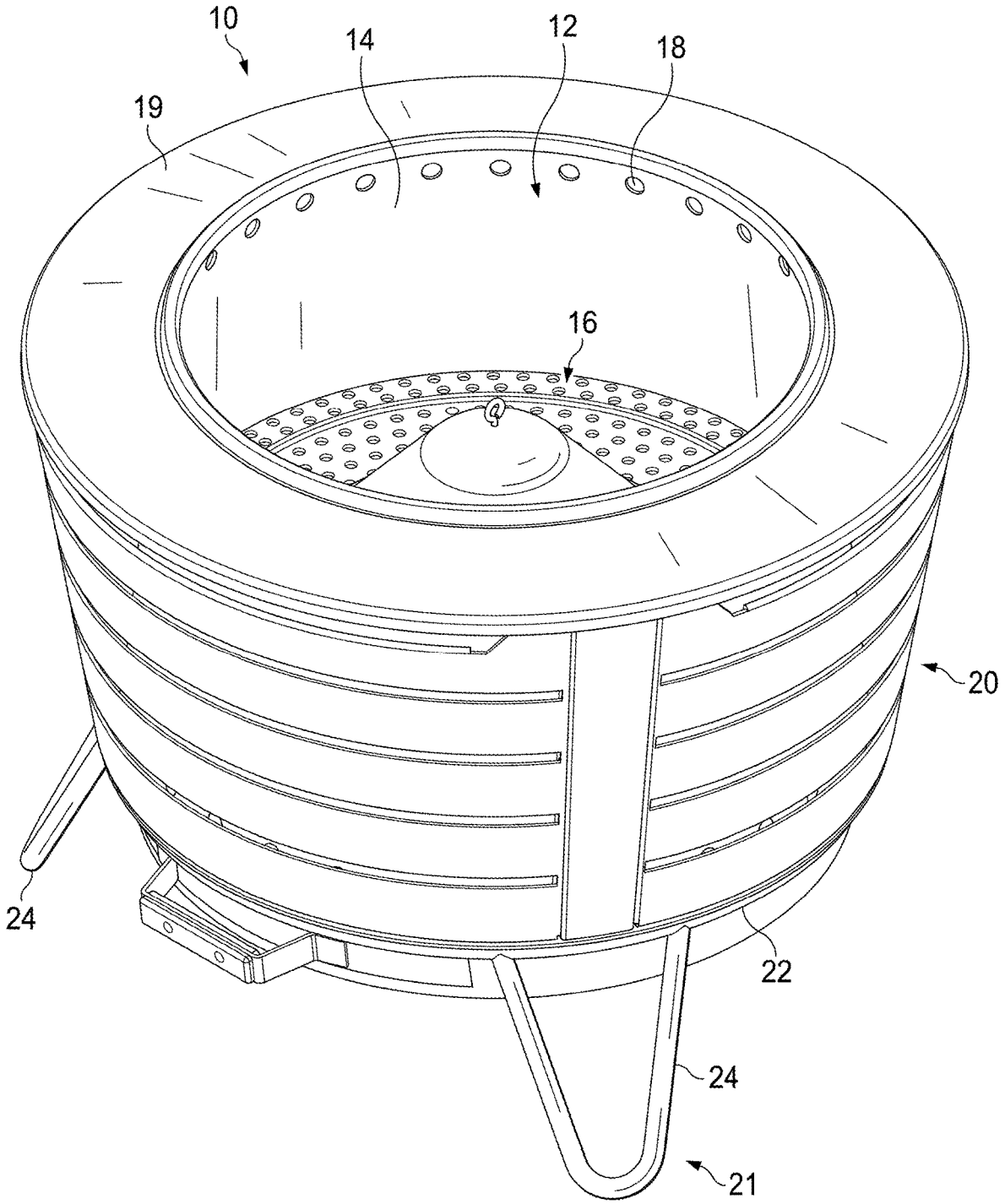
FIG. 5 is a perspective view of the example fire pit of FIG. 4.
Figure 6:
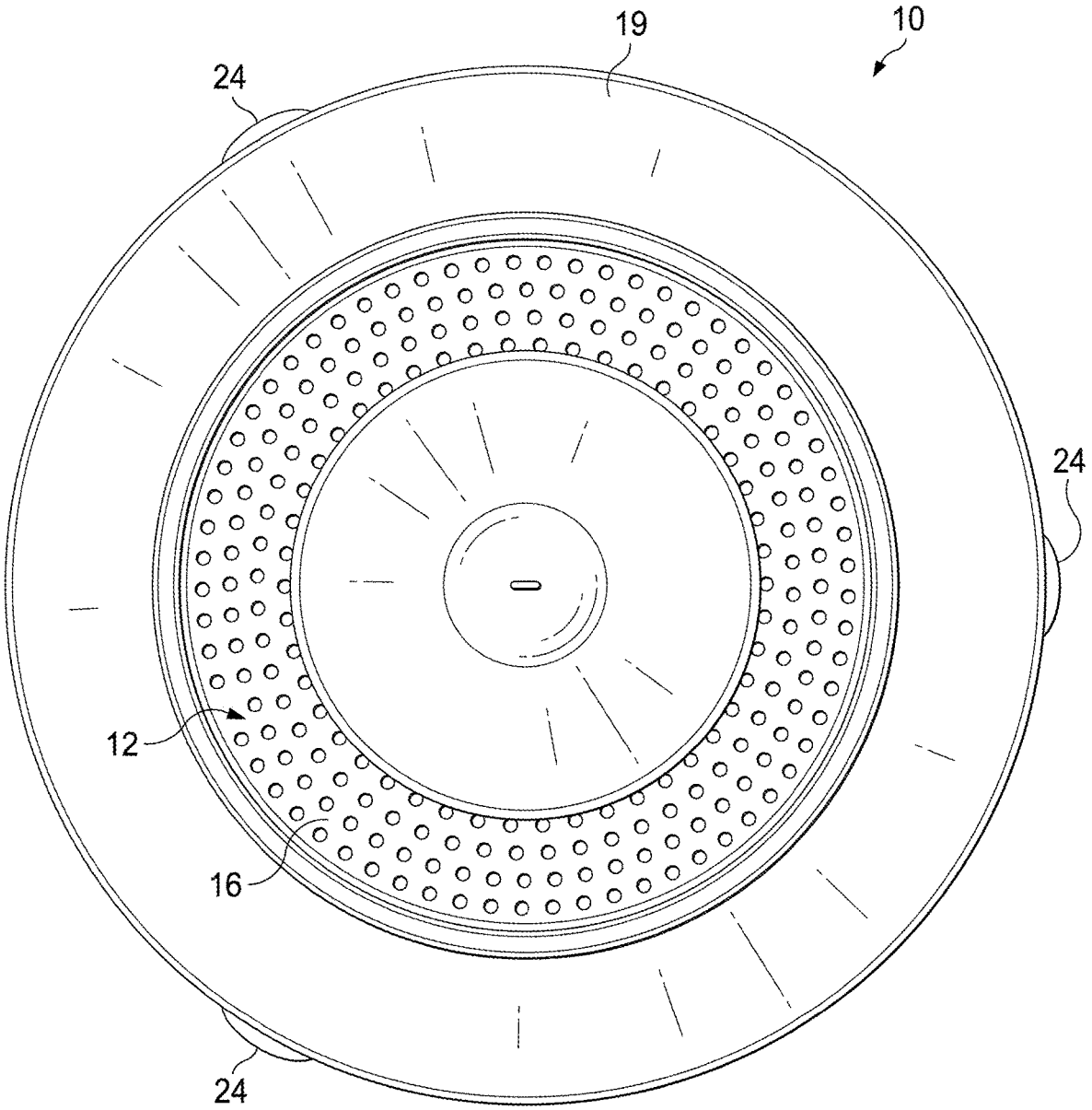
FIG. 6 is a plan view of the example fire pit of FIG. 4.

Referring now to the figures, shown is a fire pit designated generally 10. Fire pit 10 includes chamber 12. Chamber 12 is partially defined by inner chamber wall 14 and fuel grate 16. Inner chamber wall 14 preferably defines a plurality of apertures 18. Outer wall 20 surrounds inner chamber wall 14. Top panel 22 spans between inner chamber wall 14 and outer wall 20.

Stand 21 is located below outer wall 20. Stand 21 includes support ring 22. A plurality of fire pit legs 24 are affixed to support ring 22 for supporting fire pit 10. Fire pit legs 24 have a fire pit leg height 26.

Referring now to FIGS. 1-4, and 7 accessory 30 has body 32. Body 32 has upper surface 34, lower surface 36 and width 38. In one embodiment, body 32 is circular. Body 32 may also be rectangularly shaped or may be formed in other shapes. In one embodiment, width 38 is a diameter.

Accessory 30 has a plurality of accessory legs 40 extending from lower surface 36 of body 32. Each accessory leg 40 has terminal end 42. Accessory 30 has accessory height 44 from upper surface 34 to terminal end 42 of accessory legs 40. Terminal ends 42 of accessory legs 40 are configured to be received on top panel 22 of fire pit 10.

Figure 7:
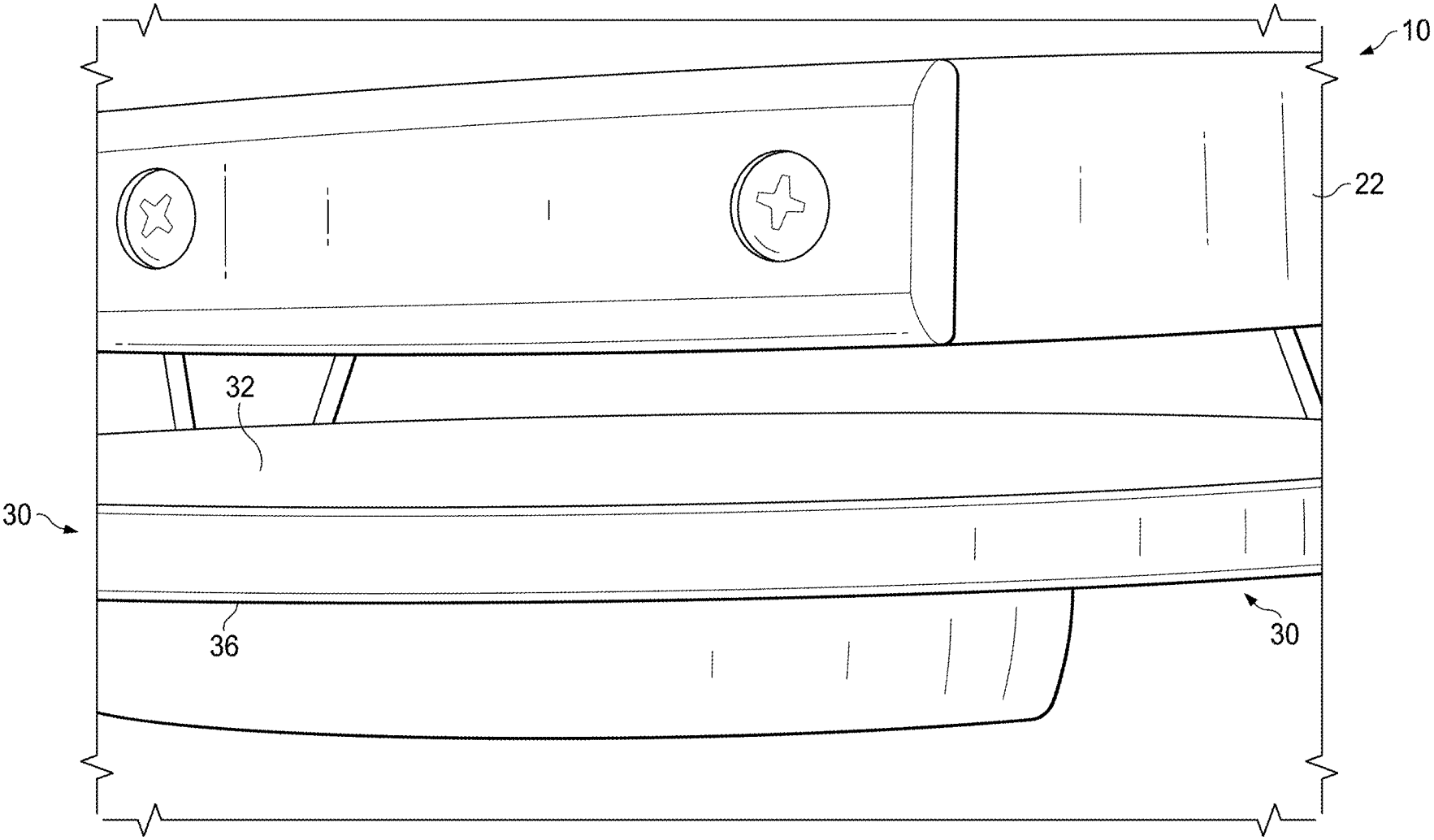
FIG. 7 is an enlarged perspective view of the accessory of FIG. 1 located underneath the fire pit for providing a thermal barrier for protecting surfaces below the fire pit from heat.
Figure 8:
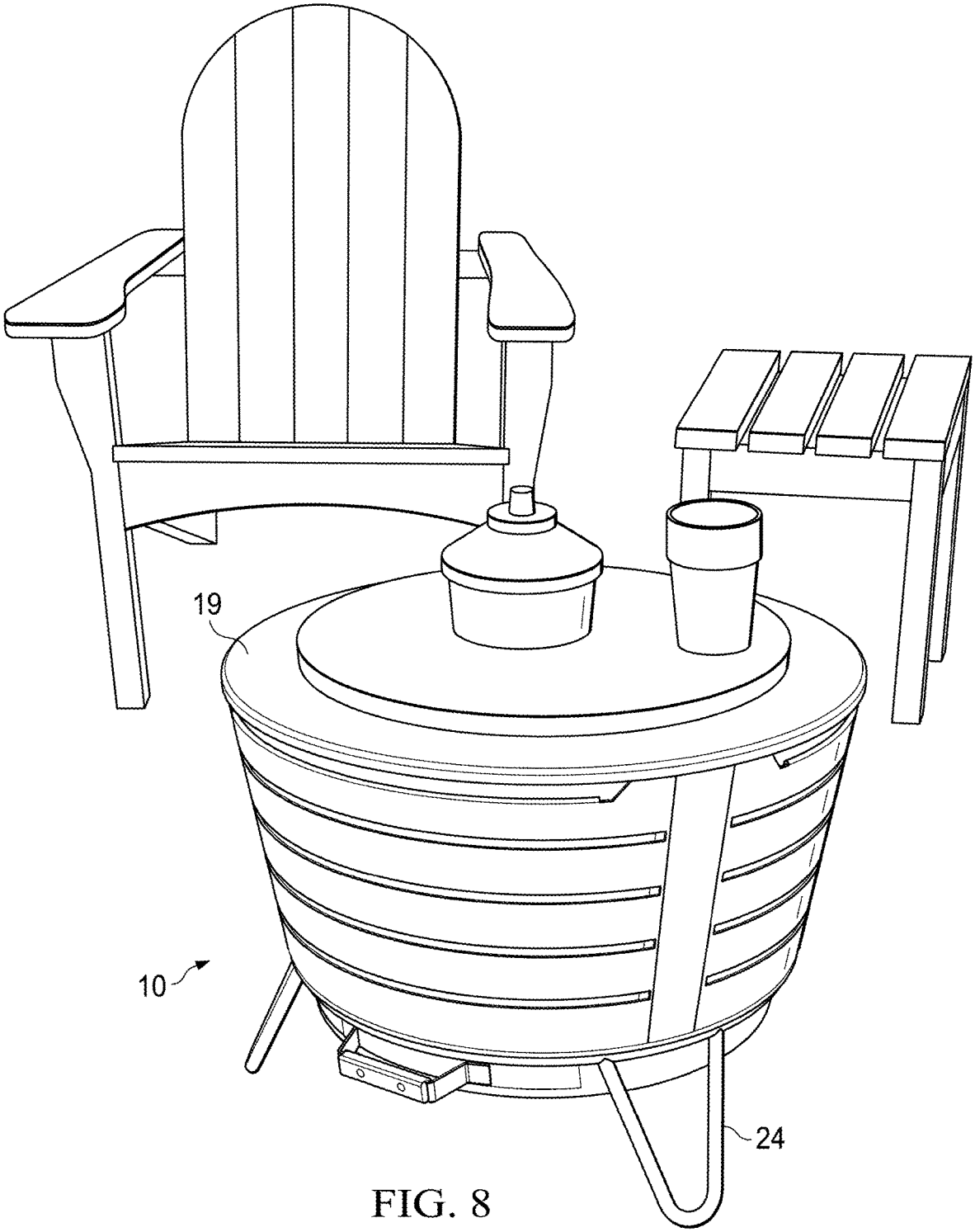
FIG. 8 is a perspective view of the accessory of FIG. 1 installed on the fire pit for use as a tabletop when the fire pit is not in use.

In a preferred embodiment, accessory height 44 is less than fire pit leg height 26 for facilitating locating accessory 30 under stand 21 of chamber 12 of fire pit 10 for use of accessory 30 as a heat shield for providing a thermal barrier to protect surfaces below the fire pit from heat (see, e.g., FIG. 7). As can best be seen in FIG. 3, accessory 30 may be formed to have an hollow interior 46 for facilitating insulative properties.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit comprising:

a chamber partially defined by an inner chamber wall;

an outer wall surrounding said inner chamber wall;

a top panel above said inner chamber wall and said outer wall;

an accessory having a body, said body having an upper surface, a lower surface and width;

said accessory having a plurality of accessory legs extending from said lower surface of said body, each of said accessory legs having a terminal end;

wherein said terminal ends of said accessory legs are configured to be received on said top panel of the fire pit.

2. The fire pit according to claim 1 further comprising:

a stand having a plurality of fire pit legs for supporting the fire pit.

3. The fire pit according to claim 2 wherein:

said upper surface of said body of said accessory is solid for functioning as a heat shield:

said accessory defines an accessory height from said upper surface of said body to said terminal ends of said accessory legs;

wherein said plurality of fire pit legs define a fire pit leg height;

wherein said accessory height is less than said fire pit leg height for facilitating locating said accessory under said chamber of the fire pit for use of said accessory as a heat shield.

4. The fire pit according to claim 1 wherein:

said body of said accessory is circular.

5. The fire pit according to claim 4 wherein:

said width of said body is a diameter.

6. The fire pit according to claim 1 wherein:

said body of said accessory is hollow and empty.

7. The table accessory according to claim 1 wherein:

said upper surface of said body of said accessory is solid for functioning as a table top.

8. A table accessory in combination with a fire pit, said combination comprising:

a body having an upper surface, a lower surface and width;

a plurality of accessory legs extending from said lower surface of said body, said accessory legs each having a terminal end;

an inner chamber wall defining a fire pit chamber having an upper end;

a top panel surrounding said upper end of said chamber; and wherein said terminal ends of said accessory legs are configured to be received on said top panel of the fire pit.

9. The table accessory according to claim 8 further comprising:

a stand having a plurality of fire pit legs for supporting the fire pit.

10. The table accessory to claim 9 wherein:

said upper surface of said boy of said accessory is solid for functioning as a heat shield:

the table accessory defining an accessory height from said upper surface of said body to said terminal ends of said accessory legs;

said fire pit legs defining a fire pit leg height;

wherein said accessory height is less than said fire pit leg height for facilitating locating the table accessory under the fire pit chamber of said fire pit for use of the table accessory as a heat shield.

11. The table accessory according to claim 8 wherein: said body is circular.

12. The table accessory according to claim 11 wherein: said width of said body is a diameter.

13. The table accessory according to claim 8 wherein: said body of said accessory is hollow and empty.

* * * * *